United States Patent [19]

Honda

[11] Patent Number: 4,530,319

[45] Date of Patent: Jul. 23, 1985

[54] HYDRAULIC LASH ADJUSTOR IN A VALVE OPERATING MECHANISM

[75] Inventor: Shoichi Honda, Tokyo, Japan

[73] Assignees: Honda Giken Kogyo Kabushiki Kaisha; Nittan Valve Co., Ltd., both of Tokyo, Japan

[21] Appl. No.: 519,537

[22] Filed: Aug. 1, 1983

[30] Foreign Application Priority Data

Jul. 30, 1982 [JP] Japan ..... 57-133375

[51] Int. Cl.[3] ..... F01L 1/24

[52] U.S. Cl. ..... 123/90.46; 123/90.55; 137/533.13

[58] Field of Search ..... 123/90.46, 90.55, 90.56, 123/90.57, 90.58, 90.59; 137/533.13

[56] References Cited

U.S. PATENT DOCUMENTS

| | | | |
|---|---|---|---|
| 2,812,750 | 11/1957 | Lesher | 123/90.55 |
| 2,981,285 | 4/1961 | Nilo | 137/533.13 X |
| 3,476,093 | 11/1969 | Line | 123/90.55 |
| 3,875,911 | 4/1975 | Joseph | 123/90.55 |

*Primary Examiner*—William R. Cline
*Assistant Examiner*—Peggy A. Neils
*Attorney, Agent, or Firm*—Armstrong, Nikaido, Marmelstein & Kubovcik

[57] ABSTRACT

Disclosed is an improved hydraulic lash adjustor in a valve operating mechanism for automatically eliminating valve head clearance of the type including a cylinder, a plunger slidably fitted into the cylinder, a hydraulic chamber defined between both the cylinder and the plunger, a hydraulic oil reservoir chamber formed in the plunger and a check valve housed in a valve cage disposed below the plunger for controlling communication between the hydraulic chamber and the hydraulic oil reservoir chamber in dependence on operation of an engine, wherein the improvement consists in that the flange portion of the valve cage is firmly held in place between the inner end surface of the plunger and a holding member fitted into an annular engagement groove formed in the cylindrical portion of the plunger. The holding member is preferably designed in the form of a caulking ring or a snap ring.

8 Claims, 7 Drawing Figures

HYDRAULIC LASH ADJUSTOR IN A VALVE OPERATING MECHANISM

BACKGROUND OF THE INVENTION

1. Field of the Invention

The present invention relates to a hydraulic valve head clearance eliminating device, that is called hydraulic lash adjustor, in a valve operating mechanism and more particularly to an improved hydraulic lash adjustor for automatically eliminating valve head clearance in the valve operating mechanism for an internal combustion engine with the aid of resilient force given by a resilient means and hydraulic force so that the valve operating mechanism can be reliably and quietly operated for a long period of time and excellent durability is assured.

2. Description of the Prior Art

In general, a hydraulic lash adjustor is equipped with a check valve located in the interior thereof so as to open or close a hydraulic passage formed in the adjustor and due to the fact that the check valve moves violently within a valve cage which serves to contain the valve therein, there is necessity for firmly holding the valve cage in order to assure that the check valve operates properly at all time.

To facilitate understanding of the present invention it will be helpful that a hitherto known hydraulic lash adjustor will be described below with reference to FIGS. 1 and 2. The hydraulic lash adjustor includes a cylinder 1 which serves as a housing therefor. As is apparent from the drawings, the cylinder 1 is designed in the form of a bottomed hollow cylinder which is open at upper end part 1*a* while having a closed bottom wall 1*b* at the lower end part thereof and which is fitted into a support hole Ea of an engine casing E. A plunger 2 with a semi-spherical top part 2*a* formed at its upper end is slidably inserted into the cylinder 1 through the open end part 1*a* and a hydraulic chamber 3 is defined between the lower end part of the plunger 2 and the bottom wall 1*b* of the cylinder 1. Further, the plunger 2 is formed with a hydraulic oil reservoir chamber 4 in the interior and has a valve bore 5 at its bottom portion by way of which bore the hydraulic oil reservoir chamber 4 is in communication with the hydraulic chamber 3. The hydraulic oil reservoir chamber 4 is in communication with a hydraulic oil supply passage 10 via a through hole 6 on the side wall of the plunger 2, an annular hydraulic passage 7 between both the sliding surfaces of the cylinder 1 and the plunger 2, a through hole 8 on the side wall of the cylinder 1 and an annular hydraulic passage 9 on the outer surface of the cylinder 1 so that the chamber 4 is always filled with hydraulic oil which is delivered through the hydraulic oil supply passage 10.

The plunger 2 includes a cylindrical portion 11 at its lower end which is adapted to abut against a shoulder 1*c* formed on the inner side wall of the cylinder 1 at a position located in the proximity of the bottom of the latter so as to define a positional limit of downward movement of the plunger 2.

A valve cage 12 is disposed in the hydraulic chamber 3. Specifically, the valve cage 12 comprises a main body 12*a* and a flange portion 12*b* made integral with the former and extending radially outward from the upper end of the body 12*a*. A through hole 13 is formed on the side wall of the main body 12*a* and the outer peripheral part of the flange portion 12*b* is fitted into an annular engagement groove 14 on the inner side wall of the cylindrical portion 11 of the plunger 2.

A check valve 15 in the form of a ball is floatably housed in the valve cage 12 so as to open or close the valve bore 5. The conventional hydraulic lash adjustor is so constructed that the check valve 15 is caused to open as hydraulic pressure in the hydraulic chamber 3 decreases and close as it increases and a stopper 16 is provided at the bottom of the valve cage 12 so as to confine a working stroke of the check valve 15. Further, to assure that the plunger 2 projects upward above the upper end of the cylinder 1 a resilient spring 17 in the form of a coil spring is contained in the hydraulic chamber 3 to apply thrusting force to the plunger 2 from the bottom side thereof.

The semi-spherical top end part 2*a* of the plunger 2 abuts against the righthand end part of a rocker arm R as seen in FIG. 1 and the lefthand end part of the latter abuts against the valve head of a poppet valve V which serves to open or close an intake valve or an exhaust valve on the engine casing E, wherein an operating cam C is disposed at a position intermediate between both the righthand and lefthand end parts of the rocker arm R so that the poppet valve V is opened by rotation of the operating cam C. The poppet valve V is usually equipped with a valve spring S in the form of a coil spring which is adapted to urge the valve in the closing direction. It should be noted that resilient force of the valve spring S is set far stronger than that of the resilient spring 17 in the hydraulic chamber 3.

Next, operation of the conventional hydraulic lash adjustor will be described below.

While the poppet valve V is kept closed, the plunger 2 is caused to move upward under the influence of resilient force of the resilient spring 17 until the righthand end part of the rocker arm R is raised up and thereby clearance between the lefthand end part of the rocker arm R and the valve head of the poppet valve V is eliminated. As the plunger 2 is raised up and thereby hydraulic pressure in the hydraulic chamber 3 decreases, the check valve 15 is opened and hydraulic oil in the hydraulic oil reservoir chamber 4 flows into the hydraulic chamber 3 via the valve bore 5 whereby the hydraulic chamber 3 is filled with hydraulic oil again.

Next, when the cam face on the operating cam C comes in contact with the rocker arm R as it is rotated, the rocker arm R is depressed its intermediate part and thereby valve opening force is generated. In response to valve opening force, hydraulic pressure is developed in the hydraulic chamber 3 which has been kept closed by means of the check valve 15 and it results that the plunger 2 is supported under application of the thus developed hydraulic pressure onto the bottom surface thereof. Thus, the rocker arm R is caused to pivot downwardly toward the poppet valve V about the semi-spherical end part 2*a* of the plunger 2 which serves as a fulcrum, whereby the poppet valve V is opened against resilient force of the valve spring S. During the downward pivoting movement of the rocker arm R, a very small amount of hydraulic oil in the hydraulic chamber 3 leaks through close clearance between the sliding surfaces of the cylinder 1 and the plunger 2 but the leaked amount of hydraulic oil will be compensated by an auxiliary supply from the hydraulic oil reservoir chamber 4 during next closing operation of the poppet valve V.

However, it has been found that a conventional hydraulic lash adjustor of the above type has the following drawbacks because of the fact that the valve cage 12 with the check valve 15 housed therein is held in place merely by fitting its flange portion 12*b* into the annular engagement groove 14 on the inner side wall of the cylindrical portion 11 of the plunger 2.

(1) There is fear of causing disconnection of the valve cage 12 from the annular engagement groove 14 when a considerably large volume of air enters the hydraulic chamber 3 during operation of an engine at a high speed or oil feeding, because the check valve 15 resonates in the valve cage 12 and a high intensity of impulsive force caused by such resonance is adversely transmitted to the valve cage 12.

(2) To inhibit disconnection of the valve cage 12 in that way there has been proposed an arrangement that interferencial dimension is provided for the flange portion 12*b* of the valve cage 12 so as to allow it to be forcibly fitted into the annular engagement groove 14. The valve cage 12 is generally manufactured by press forming, because a machining operation causes a substantially increased manufacturing cost. To practice the proposal there is necessity for maintaining dimensional tolerance of the flange portion 12*b* of the valve cage 12 within a strictly close range but it is difficult to meet this necessity so that interferencial dimension fluctuates. If the interferencial dimension is excessively small, there is fear of causing the valve cage 12 to drop out of its place in the same manner as in the foregoing. On the contrary, if it is excessively large, plastic deformation tends to take place with the flange portion 12*b* at the time of fitting into the annular engagement groove 14, resulting in an occurance of fluctuation in clearance for displacement of the check valve 15 within the valve cage 12. Furthermore, there may be a case where it becomes difficult to assure an extent of displacement of the check valve 15 required for its intended operation. In another case, there may be produced a cracking in the valve cage 12, resulting in that the valve cage 12 becomes liable to drop out of its place in the annular engagement groove 14.

(3) To assure that the flange portion 12*b* of the valve cage 12 is reliably fitted into the annular engagement groove 14 it is inevitably necessary to keep an appreciable amount of dimensional clearance between the width of the annular engagement groove 14 and the thickness of the flange portion 12*b* of the valve cage 12. However, this in turn causes the valve cage 12 to move toward and away from the plunger 2 or to rotate in the groove 14 and moreover unpleasant noise is generated due to abutment or frictional sliding movement of the former with respect to the latter. Thus, it becomes impossible to keep constant the extent or displacement of the check valve. Also in this case there is fear of causing the check valve to drop out in the above-described manner.

SUMMARY OF THE INVENTION

Hence, the present invention has been made with the foregoing background in mind and its main object resides in providing an improved hydraulic lash adjustor in a valve operating mechanism wherein a valve cage with a check valve housed therein can be firmly secured to a plunger without any fear of causing dropping of the valve cage and of generating unpleasant noise while the extent of displacement of the check valve is always maintained within a predetermined range so as to ensure proper operation of the check valve.

To accomplish the above objects there is proposed in accordance with the first aspect of the present invention an improved hydraulic lash adjustor in a valve operating mechanism of the type including a cylinder, a plunger slidably fitted into said cylinder, a hydraulic chamber defined between both the cylinder and the plunger, a hydraulic oil reservoir chamber formed in the plunger, said hydraulic oil reservoir chamber being in communication with the hydraulic chamber by way of a valve bore which is formed in the plunger, a check valve mounted to said valve bore so as to open when hydraulic pressure in the hydraulic chamber decreases and close when it increases, and a valve cage disposed on the plunger and accommodating therein the check valve, wherein the plunger is so biased by a resilient means as to project outwardly of the cylinder to support at its outermost end a rocker arm of the valve operating mechanism and wherein valve opening force generated by an operating cam of the valve operating mechanism is transmitted to the plunger as a force depressing the plunger in the axial direction, the improvement consisting in that the valve cage comprises a cap-shaped main body and a flange portion integrally extending radially outward from the peripheral end part of said main body, and the flange portion is firmly held in place between the inner end surface of the plunger and a holding member fitted into an annular engagement groove formed in the plunger.

Further, there is proposed in accordance with the second aspect of the present invention an improved hydraulic lash adjustor in a valve operating mechanism of the aforementioned type wherein the holding member is supported by a retainer fitted into the lower end part of the plunger from the bottom, the retainer being resiliently supported by the resilient means.

Since the hydraulic lash adjustor in accordance with the first aspect of the present invention is constructed such that the valve cage comprises a cap-shaped main body and a flange portion extending radially outward from the peripheral end part of the main body and the flange portion is firmly held between the inner end surface of the plunger and a holding member fitted into an annular engagement groove formed in the plunger, it is assured that the valve cage is firmly secured to the plunger without any fear of causing deformation, damage or injury and of generating unpleasant noise due to abutment or frictional sliding movement of the valve cage with respect to the plunger and moreover the check valve accommodated in the valve cage is reliably and quietly operated for a long period of time while the extent of displacement of the check valve within the valve cage is kept constant at all times.

Further, since the hydraulic lash adjustor in accordance with the second aspect of the present invention is constructed such that a holding member is supported by a retainer fitted into the lower end part of the plunger from the bottom side thereof and the retainer is in turn resiliently supported by the resilient member, the holding member can be retained more reliably, thus further enhancing advantageous functional effects obtained from the hydraulic lash adjustor in accordance with the first aspect of the present invention.

Above and other objects, features and advantages of the present invention will become more apparent from reading of the following detailed description which has been made with reference to FIGS. 3 to 7 of the accompanying drawings which illustrate several preferred embodiments of the present invention.

BRIEF DESCRIPTION OF THE DRAWINGS

The accompanying drawings will be briefly described below.

FIGS. 1 and 2 illustrate a hitherto known hydraulic lash adjustor, wherein FIG. 1 is a vertical sectional view of the whole lash adjustor and FIG. 2 is a fragmentary vertical sectional view of an essential part of the lash adjustor, shown in an enlarged scale.

FIGS. 3 and 4 illustrate a hydraulic lash adjustor in accordance with a first embodiment of the present invention, wherein FIG. 3 is a fragmentary vertical sectional view of an essential part of the lash adjustor, shown in an enlarged scale and FIG. 4 is a plan view of a caulking ring as seen in the plane taken in line IV—IV of FIG. 3.

FIGS. 5 and 6 illustrate a hydraulic lash adjustor in accordance with a second embodiment of the present invention, wherein FIG. 5 is a fragmentary vertical sectional view of an essential part of the lash adjustor, shown in an enlarged scale and FIG. 6 is a plan view of a snap ring as seen in the plane taken in line VI—VI of FIG. 5.

DESCRIPTION OF PREFERRED EMBODIMENTS

Figure 1:
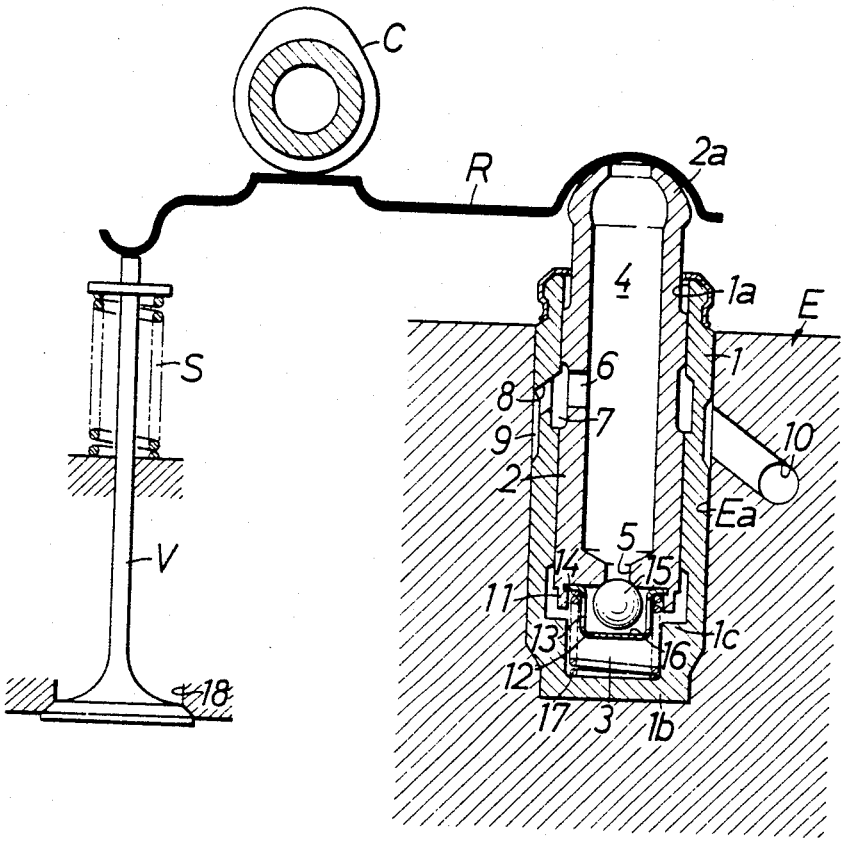
FIG 1 PRIOR ART
Figure 2:
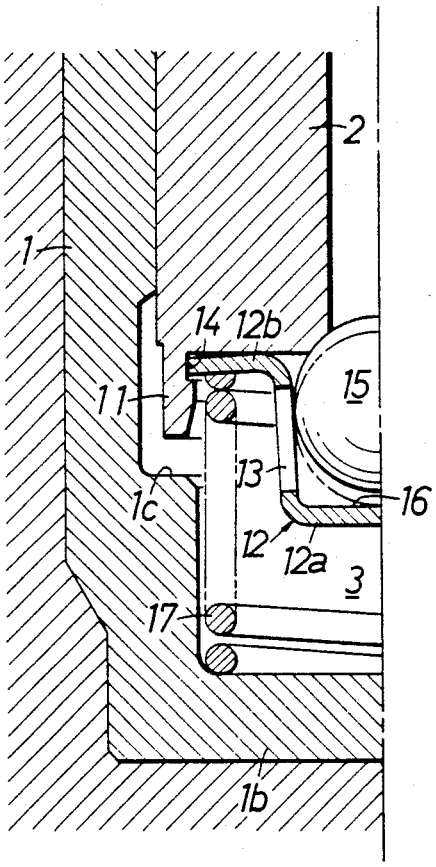
FIG 2 PRIOR ART

Now, the present invention will be described in a greater detail hereunder with reference to FIGS. 3 to 7 of the accompanying drawings which illustrate preferred embodiments of the invention. It should be noted that the same parts and components as those in FIGS. 1 and 2 are identified with the same reference characters and numerals.

Figure 3:
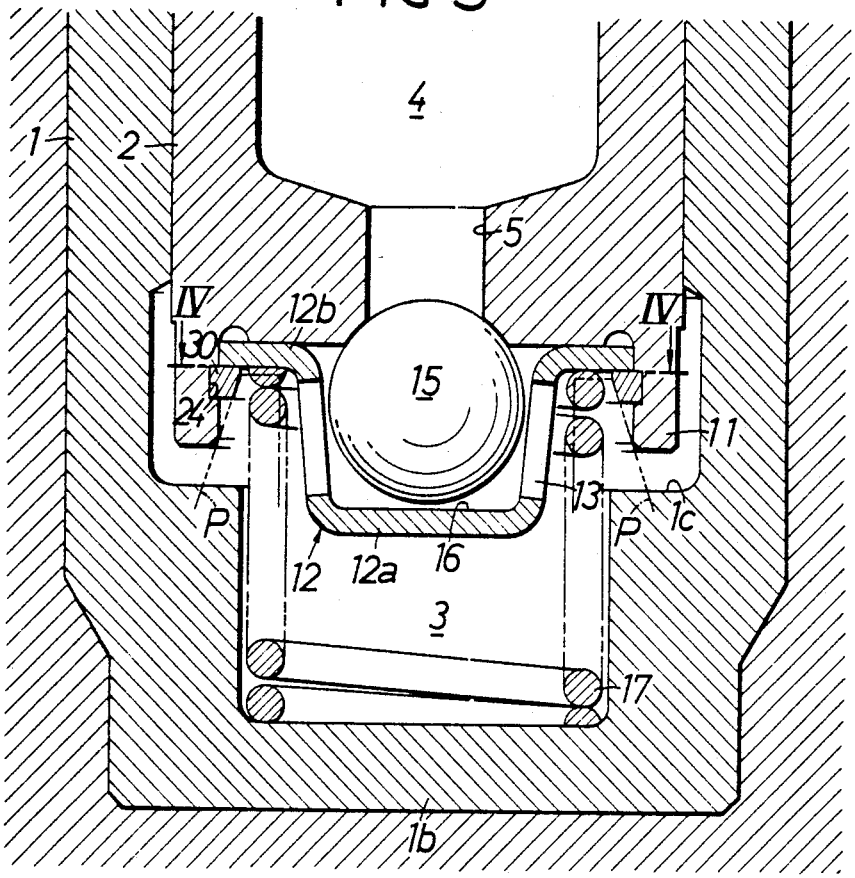
Figure 4:
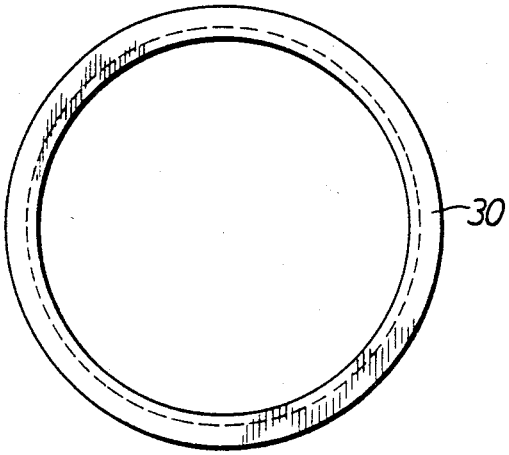

First, a hydraulic lash adjustor in accordance with the first embodiment of the invention will be described with reference to FIGS. 3 and 4.

A plunger 2 has a cylindrical portion 11 at its lower end part and an annular engagement groove 24 is formed around the inner wall surface of the cylindrical portion 11 at a position located away from the inner end surface of the plunger 2 by a distance substantially equal to the thickness of a flange portion **12*b* of a valve cage 12. The outer periphery of the flange portion 12*b* of the valve cage 12 is fitted into the inner periphery of the cylindrical portion 11 of the plunger 2. In this embodiment, there is appreciably small dimensional difference between the outer diameter of the flange portion 12*b* and the inner diameter of the cylindrical portion 11 of the plunger 2 and therefore no interferential dimension exists with respect to the cylindrical portion 11 of the plunger 2. Next, a caulking ring 30 to serve as a holding member is inserted into the cylindrical portion 11 of the plunger 2 and it is then expanded by operating a caulking punch P so as to cause it to be forcibly fitted into the engagement groove 24 whereby the flange portion 12*b* of the valve cage 12 is firmly held between the caulking ring 30 and the inner end surface of the plunger 2. Since the caulking ring 30 is subjected to plastic deformation during caulking operation until the flange portion 12*b* is tightly fitted into the annular engagement groove 24, it results that the valve cage 12 is immovably secured to the plunger 2 without any fear of causing vertical displacement or turning movement which may generate unpleasant noise due to collision or frictional sliding movement of the valve cage 12 with respect to the plunger 2. Accordingly, the distance of displacement of a check valve 15 within the valve cage 12** can be always kept constant.

Figure 5:
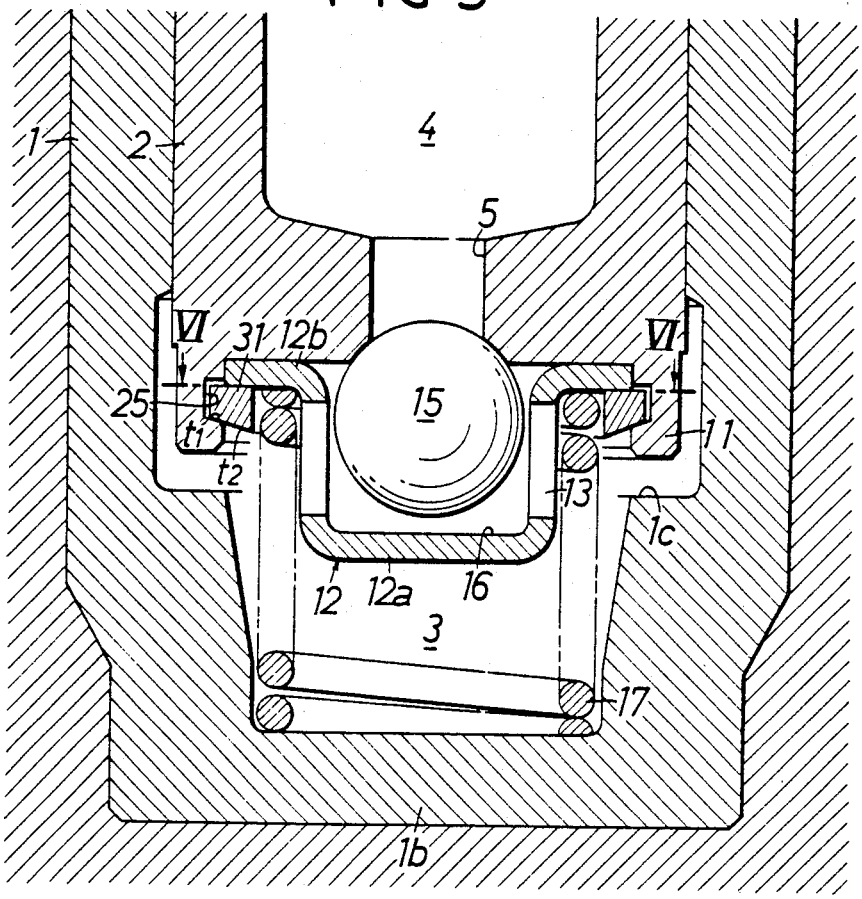
Figure 6:
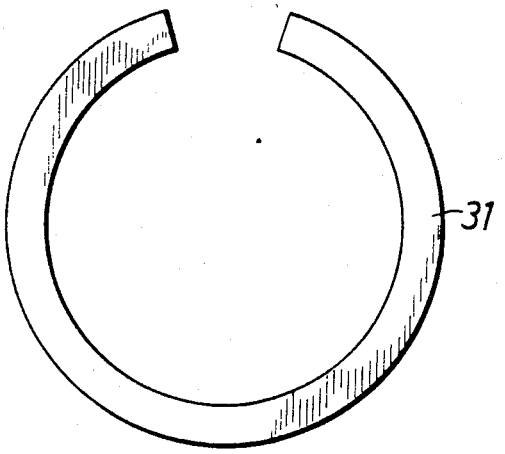

Next, a hydraulic lash adjustor in accordance with the second embodiment of the invention will be described with reference to FIGS. 5 and 6.

A plunger 2 has a cylindrical portion 11 at its lower end part and an annular engagement groove 25 having a female tapered face $t_1$ is formed around the inner wall surface of the cylindrical portion 11 at a position located away from the inner end surface of the plunger 2 by a distance appreciably less than the thickness of a flange portion **12*b*, of a valve cage 12. The outer periphery of the flange portion 12*b* of the valve cage 12 is fitted into the inner periphery of the cylindrical portion 11 of the plunger 2. Accordingly, no interferential dimension exists between the outer diameter of the flange portion 12*b* and the inner diameter of the cylindrical portion 11** either in this embodiment.

Next, a snap ring 31 having a male tapered face $t_2$ corresponding to the female tapered face $t_1$ on the annular engagement groove 25 is resiliently fitted into the groove 25. As is apparent from FIG. 6, the snap ring 31 has a cutout formed at a part thereof and it is so dimensioned to have its outer diameter larger than the inner diameter of the cylindrical portion 11 of the plunger 2 in a freely expanded state. When it is resiliently fitted into the annular engagement groove 25, clearance between the flange portion **12*b* and the snap ring 31 disappears due to tight engagement of the male tapered face $t_2$ to the female tapered face $t_1$ whereby the flange portion 12*b* of the valve cage 12 is immovably held between the inner end surface of the plunger 2 and the snap ring 31 without causing vertical displacement or turning movement of the valve cage 12. If a coil spring 17 is so arranged to provide only a small clearance between itself and the snap ring 31, the snap ring 31 can be prevented from dropping out of the annular engagement groove 25 by abutment against the spring 17**.

Figure 7:
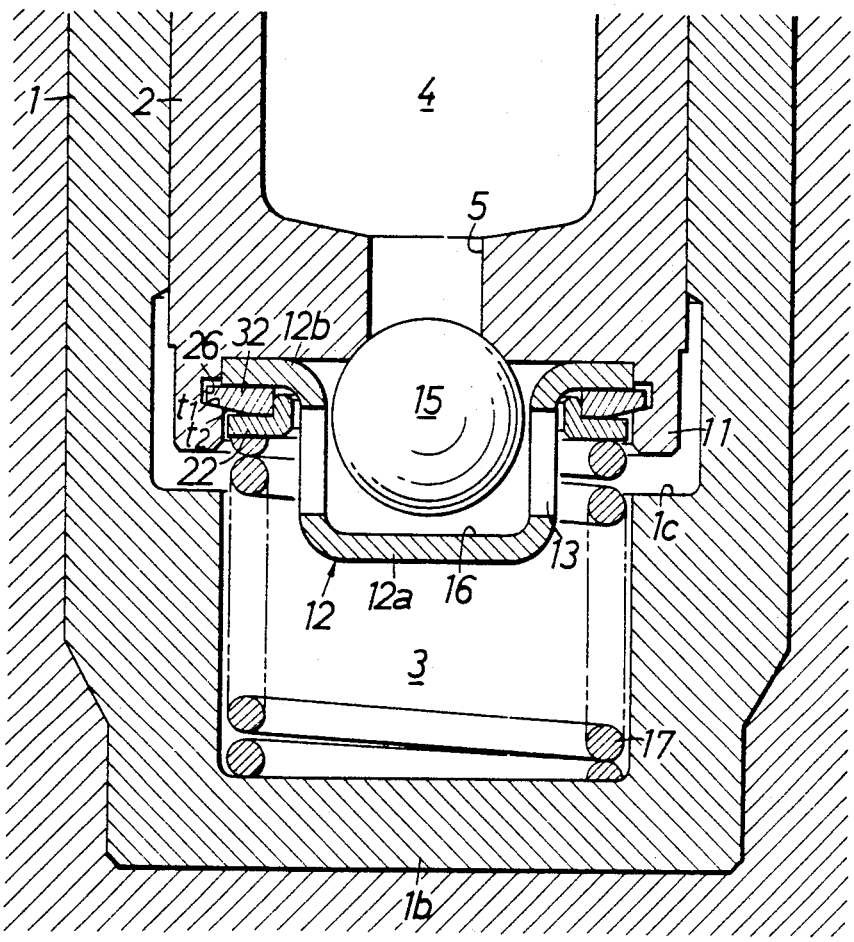
FIG. 7 is a fragmentary vertical sectional view of an essential part of a hydraulic lash adjustor in accordance with a third embodiment of the present invention, shown in an enlarged scale.

Next, a hydraulic lash adjustor in accordance with the third embodiment of the invention will be described with reference to FIG. 7.

The third embodiment provides a special means for preventing a snap ring 32 from dropping out of the annular engagement groove 26 in addition to the arrangement as disclosed in the above-described second embodiment. Specifically, after the snap ring 32 is resiliently fitted into the annular engagement groove 26, a retainer 22 is additionally inserted into the cylindrical portion 11 of the plunger 2 and a coil spring 17 is then disposed below the retainer 22 in such a manner as to resiliently support the retainer 22 from the bottom side thereof.

Thus, in this third embodiment, the snap ring 32 can be held in the annular engagement groove 26 in a more reliable manner so that the flange portion **12*b* of the valve cage 12 can be more securely fixed in place between the inner end surface of the plunger 2 and the snap ring 32**.

While the present invention has been described above with respect to several preferred embodiments, it should be of cource understood that the invention should not be limited to them but many changes or modifications may be made in a suitable manner without any departure from the spirit and scope of the invention as defined by appended claims.

What is claimed is:

1. In a hydraulic lash adjustor in a valve operating mechanism of the type including a cylinder, a plunger slidably fitted into said cylinder having a top end and a bottom portion having a lower end with a surface, a hydraulic chamber defined between both the cylinder and the plunger, a hydraulic oil reservoir chamber formed in the plunger, said hydraulic oil reservoir chamber being in communication with the hydraulic chamber by way of a valve bore which is formed in the lower end surface of the plunger, a check valve disposed so as to open said valve bore when hydraulic pressure in the hydraulic chamber decreases and close said valve bore when it increases, and a valve cage disposed on the lower end of the plunger and accommodating therein the check valve, the valve cage consisting of a cap-shaped main body and a flange portion integrally extending radially outward from a peripheral end part of said main body, wherein the plunger is biased by a resilient means as to project outwardly of the cylinder to support at its top end a rocker arm of the valve operating mechanism and wherein valve opening force generated by an operating cam of the valve operating mechanism is transmitted to the plunger as a force depressing the plunger in an axial direction, the improvement wherein the lower end of the plunger has a cylindrical extension portion with an inner surface having an inner diameter, and the flange portion of the valve cage is firmly held in place between the lower end surface of the plunger and a holding member fitted into an annular engagement groove formed in the inner surface of the cylindrical extension portion of the plunger.

2. A hydraulic lash adjustor in a valve operating mechanism as defined in claim 1, wherein said holding member is constructed as a caulking ring adapted to be fitted into said annular engagement groove by caulking operation so that the flange portion of the valve cage is firmly held between the lower end surface of the plunger and the caulking ring.

3. A hydraulic lash adjustor in a valve operating mechanism as defined in claim 1, wherein said holding member is constructed as a snap ring with a cutout formed thereon, said snap ring being resiliently fitted into said annular engagement groove so that the flange portion of the valve cage is firmly held between the lower end surface of the plunger and the snap ring.

4. A hydraulic lash adjustor in a valve operating mechanism as defined in claim 1, wherein said holding member is supported by a retainer fitted into the lower end of the plunger from the bottom side thereof, said retainer being resiliently supported by said resilient member.

5. A hydraulic lash adjustor in a valve operating mechanism as defined in claim 3 or 4, wherein said annular engagement groove has a lower side wall surface designed in the form of a tapered face extending radially inward at a downward inclination angle with respect to a plane vertical to the axis of the plunger.

6. A hydraulic lash adjustor in a valve operating mechanism as defined in claim 1, wherein said annular engagement groove is formed on the inner surface of the cylindrical extension portion of the plunger at a position spaced from the lower end surface of the plunger by a distance equal to or less than the thickness of the flange portion of the valve cage.

7. A hydraulic lash adjustor in a valve operating mechanism as defined in claim 1, wherein no interferential dimension exists between the outer diameter of the flange portion of the valve cage and the inner diameter of the cylindrical extension portion of the plunger.

8. A hydraulic lash adjustor in a valve operating mechanism as defined in claim 3, wherein said resilient member is accommodated in the hydraulic chamber in such a manner that its upper end abuts against the lower surface of the flange portion of the valve cage and an appreciably small dimensional clearance is provided in the radial direction between the resilient member and the inner wall face of the snap ring after the snap ring is fitted into the annular engagement groove.

* * * * *